US009229462B2

(12) United States Patent
Shukla et al.

(10) Patent No.: US 9,229,462 B2
(45) Date of Patent: Jan. 5, 2016

(54) CAPLESS ON CHIP VOLTAGE REGULATOR USING ADAPTIVE BULK BIAS

(71) Applicant: STMicroelectronics International N.V., Schiphol (NL)

(72) Inventors: Hemant Shukla, Bangalore (IN); Saurabh Kumar Singh, Noida (IN); Nitin Bansal, Gurgaon (IN)

(73) Assignee: STMicroelectronics International N.V., Schiphol (NL)

( * ) Notice: Subject to any disclaimer, the term of this patent is extended or adjusted under 35 U.S.C. 154(b) by 0 days.

(21) Appl. No.: 14/788,682

(22) Filed: Jun. 30, 2015

(65) Prior Publication Data

US 2015/0301540 A1 Oct. 22, 2015

Related U.S. Application Data

(63) Continuation-in-part of application No. 13/929,549, filed on Jun. 27, 2013.

(51) Int. Cl.
*G05F 1/10* (2006.01)
*G05F 1/46* (2006.01)

(52) U.S. Cl.
CPC ..... *G05F 1/468* (2013.01)

(58) Field of Classification Search
CPC ..... G05F 1/468; G05F 1/56
See application file for complete search history.

(56) References Cited

U.S. PATENT DOCUMENTS 3,794,921 A 2/1974 Unkauf
4,484,295 A 11/1984 Bedard et al.
6,847,260 B2 1/2005 Gupta et al.
2005/0134242 A1 6/2005 Gradinariu
2006/0055383 A1* 3/2006 Eberlein ..... G05F 1/575 323/280
2008/0174289 A1* 7/2008 Gurcan ..... G05F 1/575 323/280
2010/0079121 A1* 4/2010 Yanagawa ..... G05F 1/575 323/277
2011/0001458 A1* 1/2011 Bansal ..... G05F 1/575 323/282
2011/0267017 A1* 11/2011 Zhang ..... G05F 1/575 323/280
2012/0169303 A1 7/2012 Chen

OTHER PUBLICATIONS

Liu, Xin et al., "Design of Off-Chip Capacitor-Free CMOS Low-Dropout Voltage Regulator," Circuits and Systems, 2008, APCCAS 2008, IEEE Asia Pacific Conference, pp. 1316-1319.

Rincon-Mora, Gabriel, "Active Capacitor Multiplier in Miller-Compensated Circuits," IEEE Transactions on Solid-State Circuits, vol. 35, No. 1 Jan. 2000, pp. 26-32.

Toumazou, et al., (eds.), *Analogue IC design: the current mode approach,* Peter Peregrinus Ltd., Stevenage, U.K., 1990, 7 pages.

* cited by examiner

*Primary Examiner* — Jue Zhang
(74) *Attorney, Agent, or Firm* — Seed IP Law Group PLLC

(57) ABSTRACT

An FDSOI integrated circuit die supplies on an output node a regulated output voltage based on a reference voltage. A pass transistor that passes a first current to the output node. A feedback loop regulates the output voltage by generating a second current based on the first current and applying a control signal to the pass transistor based on the second current. A loop current adaptor adapts a ratio of the first and second currents by adjusting a back gate bias voltage applied to a back gate of loop transistor of the feedback loop.

21 Claims, 16 Drawing Sheets

CAPLESS ON CHIP VOLTAGE REGULATOR USING ADAPTIVE BULK BIAS

CROSS REFERENCE TO RELATED APPLICATION

The present application is a continuation-in-part of U.S. patent application Ser. No. 13/929,549, filed Jun. 27, 2013.

BACKGROUND

1. Technical Field

The present application related to the regulation of output voltage and in particular, but not exclusively, to circuits used for such regulation.

2. Description of the Related Art

Voltage regulators may be used to keep a supply voltage stable in the presence of varying load conditions. These may be implemented on an on-chip environment however due to stability and transient response requirements of the on-chip environment an off-chip capacitor is often implemented as part of the voltage regulator. An off-chip capacitor adds to a cost of manufacture as well as prevents a fully on-chip implementation of a system.

BRIEF SUMMARY

According to a first aspect, there is provided an apparatus comprising: a plurality of devices forming a positive feedback loop for driving a regulated output voltage towards a reference voltage; wherein device ratios of at least two of the plurality of devices are set such that the positive feedback loop is stable.

The plurality of devices may comprise a sensing element configured to sense a change in the regulated output voltage. The plurality of devices may comprise a control element configured to generate a control signal in response to an indication of the sensed change in the regulated output voltage. The control signal may drive the regulated output voltage towards the reference voltage.

A relationship between the device ratio of the sensing element and the device ratio of the control element may be such that the loop is stable.

The plurality of devices may comprise a current mirror configured to provide the indication of the change to the control element. The current mirror may be configured to provide the indication of the change by adjusting a current provided to the control element in response to the sensing element sensing a change in the regulated output voltage.

The current mirror may comprise a first and second device and a relationship between a device ratio of the first device and a device ratio of the second device may be such that the positive feedback loop is stable.

The plurality of devices may be transistors and a device ratio may correspond to a gate width to length ratio of a device. The relationship between the device ratios providing a stable loop gain may provide a loop gain of the positive feedback loop to be less than one. The apparatus may be a voltage regulator.

According to a second aspect, there is provided a method comprising: driving a regulated output voltage towards a reference voltage by a positive feedback loop formed by a plurality of devices; wherein device ratios of at least two of the plurality of devices are set such that the positive feedback loop is stable.

The method may further comprise: sensing by a sensing element a change in the regulated output voltage. The method may further comprise: generating by a control element a control signal in response to an indication of the sensed change in the regulated output voltage.

Driving the regulated output voltage towards the reference voltage may comprise driving the regulated output voltage towards the reference voltage by the control signal. A relationship between the device ratio of the sensing element and the device ratio of the control element may be such that the loop is stable.

The plurality of devices may comprise a current mirror and the method may further comprise: providing the indication of the change to the control element by the current mirror.

The method may further comprise: providing the indication of the change by adjusting a current provided to the control element in response to the sensing element sensing a change in the regulated output voltage.

The current mirror may comprise a first and second device and a relationship between a device ratio of the first device and a device ratio of the second device may be such that the positive feedback loop is stable.

The plurality of devices may be transistors and a device ratio may correspond to a gate width to length ratio of a device. The relationship between the device ratios providing a stable loop gain may provide a loop gain of the positive feedback loop to be less than one.

BRIEF DESCRIPTION OF THE SEVERAL VIEWS OF THE DRAWINGS

Embodiments of the present application will now be described with reference to the following figures in which.

DETAILED DESCRIPTION

Voltage regulators implemented on an integrated circuit, often called on-chip regulators, usually require a capacitor, for example, on the order of a micro farad, to be connected externally to the integrated circuit, often called an off-chip component. This off-chip capacitor is necessary to support the stability and improve a transient performance of the on-chip voltage regulator. The requirement of the off-chip capacitor may add to the cost of the voltage regulator and prevents fully on chip implementation.

Designs and techniques omitting the off-chip capacitor may require the output capacitance to be very small (for example, few hundred picofarads) which may cause poor transient performance. These designs may not be suited for many applications of the on-chip voltage regulator.

Embodiments of the present application may provide a voltage regulator suitable for on-chip implementation without the need for an off-chip capacitor. In some embodiments, a stability of the voltage regulator may be dependent on a ratio of devices used to implement the regulator rather than a capacitor. In some embodiments an NMOS pass element and a positive feedback circuit may be implemented to provide a transient response suitable for the voltage regulator.

Figure 1:
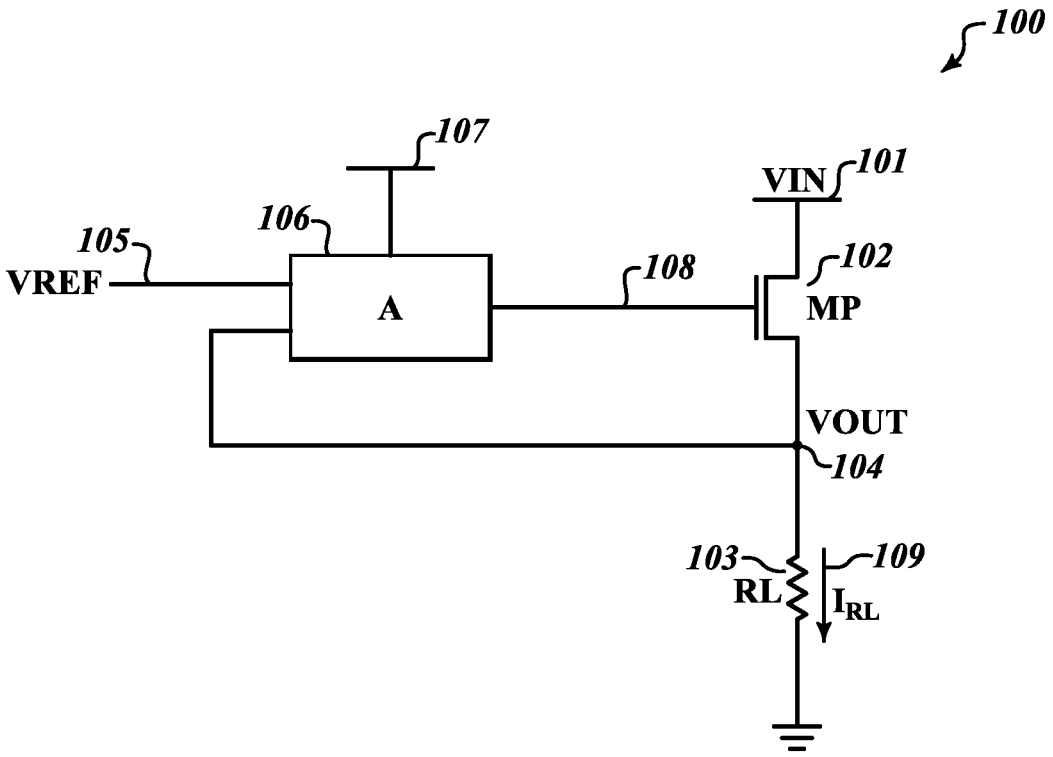
FIGS. 1 and 2 show schematic diagrams of a voltage regulator circuit according to embodiments.

FIG. 1 shows an example of a voltage regulator according to one inventive embodiment.

FIG. 1 comprises an unregulated voltage input Vin 101 and a voltage output Vout 104. The voltage input Vin 101 may be regulated by a voltage regulator 100 in order to provide the regulated voltage output Vout 104 to the rest of the integrated circuit. Vout 104 is provided across a load RL 103. RL may represent the load provided by the integrated circuit. It will be appreciated that the load RL 103 may be variable depending on the operation of the integrated circuit. The current $I_{RL}$ may therefore vary over time and it is desired to hold Vout constant with variations in RL and $I_{RL}$.

A pass element 102, in this case an NMOS field effect transistor, is provided with its drain terminal connected to the voltage input Vin 101, source terminal connected to the voltage output Vout 104 and gate terminal connected to the output of a block A 106.

The pass element 102 may be configured to pass a current $I_{RL}$ 109 to the load RL 103 of the integrated circuit.

The voltage regulator 100 may further include a reference voltage Vref 105 and a supply voltage 107 both coupled as inputs to the block A 106. The block A may also have an input coupled to Vout 104.

The voltage regulator 100 may control the gate terminal voltage 108 of the pass element 102 in order to control Vout 104 to correspond to Vref 105. It will be appreciated that in some embodiments, Vout 104 is controlled to be substantially equal to Vref 105 however in other embodiments, Vout 104 may be controlled to be a multiple or factor of Vref 105 or have an offset with respect to Vref 105.

The value of Vout 104 may be dependent on the values of $I_{RL}$ and RL as follows:

$$Vout = I_{RL} \times R_L \quad \text{(i)}$$

RL may be variable and the voltage regulator 100 may be operable to adjust the current $I_{RL}$ passed by the pass element in order to drive Vout 104 to correspond with Vref 105. In order to do this block A may control the voltage of the gate terminal 108 to adjust the gate source voltage Vgs of the pass element 102 which in turn controls the current $I_{RL}$ 109.

Block A may operate as a positive feedback loop. For example, a decrease in an internal current in block A may cause a decrease in Vout which causes the voltage of the gate terminal 108 to be adjusted to decrease the current $I_{RL}$ 109. In other words a decrease in the current of a sensing element in block A will result in a decrease in the current $I_{RL}$ 109. Similarly, an increase in the current of the sensing element in block A (due to for example a decrease in the load RL), will result in an increase of the current $I_{RL}$ 109.

In embodiments, the positive feedback loop may have a gain less than or in the vicinity of 1 to provide an unconditionally stable loop.

It will be appreciated that the value of the loop gain may be chosen to be close enough to 1 that the loop is unconditionally stable. For example the gain may be in the vicinity of 0.6 to 0.9.

Figure 2:
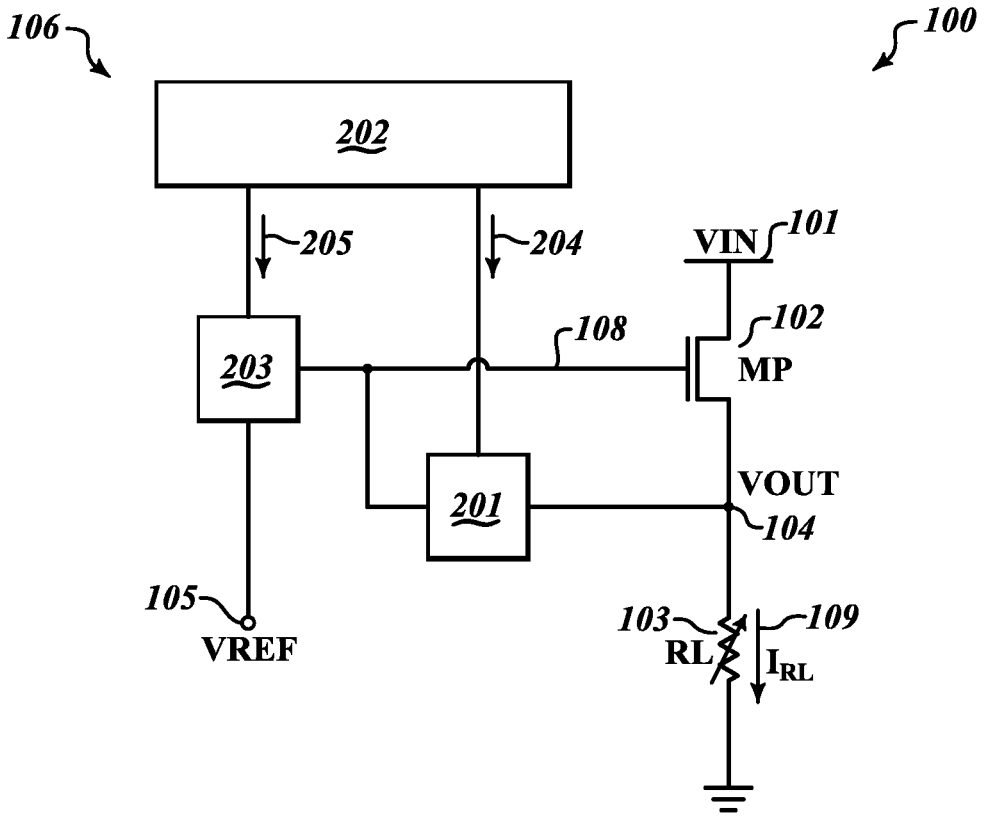

FIG. 2 shows an embodiment of the components of block A.

FIG. 2 comprises the reference voltage Vref 105, voltage Vin 101, pass element 102, output voltage Vout 104 and load RL 103 and shows the current $I_{RL}$ 109 as described in relation to FIG. 1.

FIG. 2 further shows a sensing element 201, current mirror 202 and control element 203. The control element 203 may be coupled to Vref 105, to the gate terminal 108 of the pass element 102 and to the current mirror 202. A control current 205 may be provided to the control element 203 from the current mirror 202.

The sensing element 201 may be coupled to Vout 104, to the connection between the control element 203 and the gate terminal 108 and to the current mirror 202. A sensing current 204 between the current mirror 202 and the sensing element 201 may be set by the sensing element 201.

In operation, the sensing element 201 may sense a change in Vout 104 which may adjust the sensing current 204. The current mirror 202 will adjust the control current 205 to mirror the adjusted sensing current 204 and provide the control current 205 to the control element 203. The adjusted control current 205 will cause the control element 203 to adjust the gate terminal 108 voltage of the pass element 102. The adjusted gate terminal voltage 108 will drive Vout towards the reference voltage Vref 105.

Figure 3:
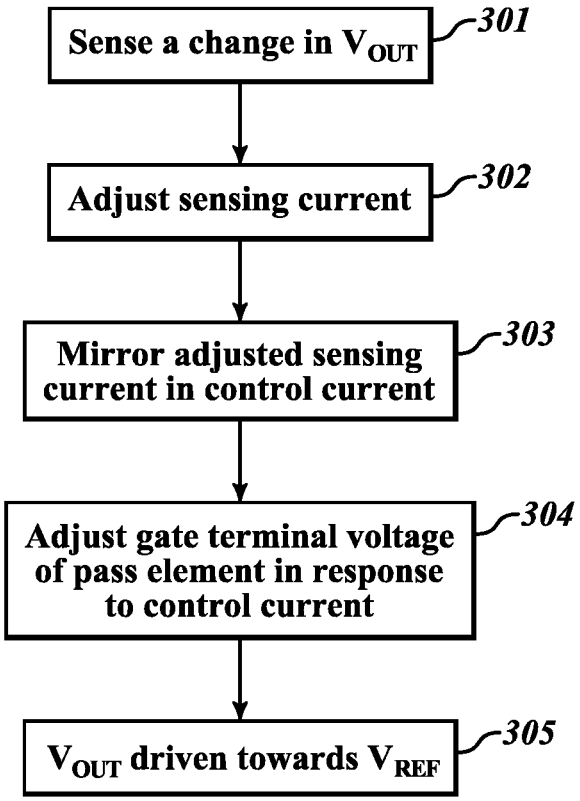
FIG. 3 is a flow diagram depicting the method step associated with some embodiments.

FIG. 3 shows an example of the method steps carried out in accordance with the embodiment of FIG. 2.

At step 301 a change in the regulated voltage output is sensed. The sensed change in the regulated output voltage may cause a current through the sensing device to change as shown in step 302.

At step 303, a control current is adjusted by mirroring the sensing current. While, in the foregoing, the control current adjustment is described as being carried out by a current mirror, it will be appreciated that the adjustment may be carried out by any suitable circuitry.

The method then proceeds to step 304 where the gate terminal voltage of the pass element 102 is adjusted in response to the adjusted control current 205.

At step 305, the regulated voltage 104 is adjusted in response to the gate terminal voltage 108 to drive the regulated voltage back towards the reference voltage. With this positive feedback loop, the level of Vout is kept constant.

Figure 4:
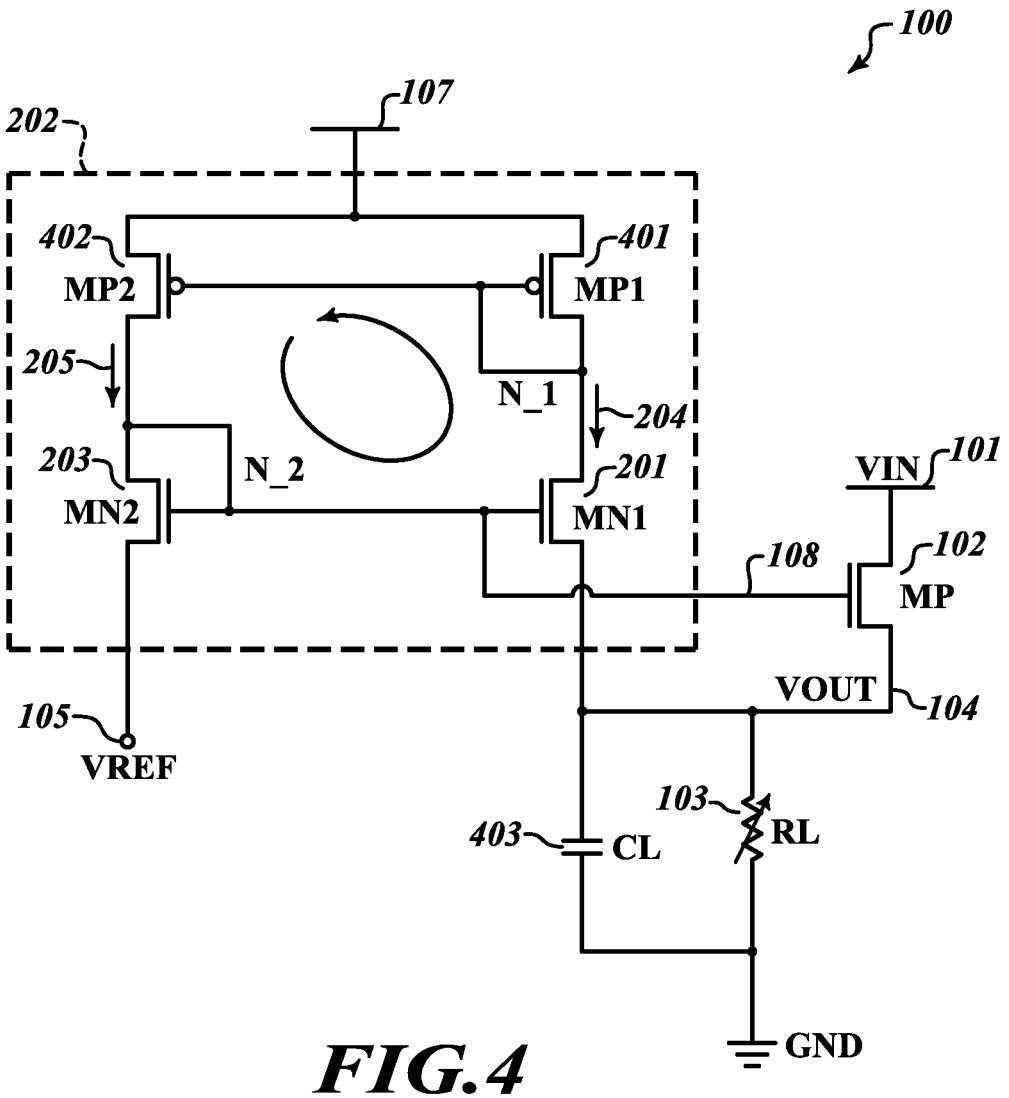
FIG. 4 is a circuit diagram of a voltage regulator according to one embodiment.

FIG. 4 shows the circuitry of block A 106 according to a first embodiment.

It will be appreciated that the embodiment of FIG. 4 is one example of the specific devices for use in the embodiments of FIGS. 1 to 3. Like reference numerals indicate like features.

In the embodiment of FIG. 4, the sensing element 201 may comprise a first n-channel MOSFET MN1 and the control element 203 may comprise a second n-channel MOSFET MN2. The current mirror 202 may comprise a first p-channel MOSFET MP1 401 and a second p-channel MOSFET MP2 402.

A source terminal of MN1 201 may be coupled to the regulated voltage output Vout 104. A drain terminal of MN1 201 may be coupled to a drain terminal of MP1 401. A gate terminal of MN1 201 may be coupled to the gate terminal 108 of the pass element 102 and to a gate terminal of MN2 203.

The gate terminal of MN2 203 may further be coupled to a drain terminal MP2 402. A source terminal MN2 203 may be coupled to the reference voltage Vref 105. The drain terminal of MN2 203 may be further coupled to a drain terminal of MP2 402.

With MP1 and MP2 forming the current mirror 202, the drain terminal of MP1 401 may further be coupled to a gate terminal of MP1 401. A source terminal of MP1 401 and a source terminal MP2 402 may both be coupled to the supply voltage 107. The respective gate terminals MP1 401 and MP2 402 may be coupled together.

The embodiment of FIG. 4 may further include an on-chip capacitor 403 coupled across the load RL 103. A first terminal of the on-chip capacitor 403 may be coupled to the source terminal of MN1 201 and Vout 104. A second terminal of the capacitor 403 may be coupled to ground.

The sensing current 204 may flow from the drain terminal of MP1 401 to the drain terminal of MN1 201. The control current 205 may flow from the drain terminal of MP2 402 to the drain terminal of MN2 203.

The sensing element 201, current mirror 202 and control element 203 act as a positive feedback loop providing the control voltage at the gate terminal of the pass element MP 102.

In operation, a change in Vout 104 is a change in the voltage at the source terminal of the sensing element MN1 201. The change in the source terminal voltage of MN1 201 additionally changes the gate source voltage $V_{GS}$ of the sensing element MN1 201 which causes a change in the sensing current 204 being passed through the sensing element 201.

The current being passed through MP1 401 is the sensing current 204 and a source gate voltage $V_{SG}$ of MP1 will be adjusted in response thereto. The gate voltage of MP1 sets the gate voltage of MP2 and thus the source gate voltage $V_{SG}$ changes accordingly. The change in $V_{SG}$ of MP2 causes the control current 205 being passed through MP2 to change.

In this manner the sensing current 204 is mirrored in the control current 205 by the current mirror. It will be appreciated that the configuration of the current mirror 202 in the embodiment of FIG. 4 is by way of example only and other configurations of a current mirror or circuitry having the necessary functionality may be realized without departing from the scope of the invention.

The control current 205, set by the current mirror 202, is passed through the control element MN2 203. A change in the control current 205 causes the gate source voltage $V_{GS}$ of MN2 to be adjusted. It will be appreciated that with the drain terminal of MN2 coupled to the gate terminal of MN2, the transistor MN2 will be in saturation mode. As the source terminal of MN2 is coupled to the reference voltage Vref 105, the voltage at the gate terminal of MN2 is changed in response to the change in $V_{GS}$ and the control current 205.

The reference voltage Vref 105 plus the $V_{GS}$ of MN2 203 is equal to the $V_{GS}$ of the control element MN1 102 plus the regulated output voltage Vout 104 which can be shown by the following equation:

$$V_{REF}+V_{GSMN2}=V_{GSMN1}+V_{OUT} \quad \text{(ii)}$$

It will be appreciated that while $V_{GSMN2}$ and $V_{GSMN1}$ are not exactly matched in size, their sizes are close enough to approximate $V_{GSMN2}\approx V_{GSMN1}$ in this equation. In some embodiments, the difference in size between these transistors causes load regulation and is a trade-off for stability. For example if sizes of MN1 and MN2 are very close then $V_{REF}$ and $V_{OUT}$ will be very close to each other but the stability will be poor.

Equation (ii) may then this simplify to:

$$V_{REF}=V_{OUT} \quad \text{(iii)}$$

In the embodiment of FIG. 4, the reference voltage $V_{REF}$ 105 is provided as a node with low impedance, for example a buffered node. Examples of such a low impedance node are discussed in relation with FIGS. 5A and 6.

The sensing element 201, current mirror 202 and control element 203 may form a positive feedback loop. This positive feedback loop may further be designed having device ratios that bring the loop gain close to 1. The stability of the voltage regulator may be provided by having this positive feedback loop having device ratios providing a gain of close to 1. The voltage regulator of these embodiments therefore does not require an external capacitor to ensure stability.

The voltage regulator 100 may include an on-chip capacitor $C_L$ 403. The capacitor $C_L$ 403 provides immediate additional current in the event of any sudden transient current requirements. However $C_L$ 403 is preferably implemented on-chip and may be in the range of a few hundred picofarads to a few nano farads depending on the application. The circuit arrangement permits the capacitor 403 to be very small.

As described above, the voltage regulator of some embodiments may comprise a positive feedback loop having a sensing element and a control element. The sensing element may sense a change in an output voltage, provide this information to the control element and the control element may regulate or control the output voltage to correspond to a reference voltage. The control element may counteract any change in the output voltage so that the output voltage is regulated to the reference voltage.

The stability of the positive feedback loop may be provided by adjusting the device ratio of the sensing element and the control element to control a loop gain. The ratios may be designed or chosen so that the loop is stable. An external or off-chip capacitor may not be required and the voltage regulator may be implemented on-chip.

The gain of the positive feedback loop may be determined by the trans-conductance and impedance of the devices in the loop. The determination of loop gain and the selection of device ratios will be discussed in relation to the embodiment of FIG. 4.

The positive feedback loop of FIG. 4 comprises four devices: the sensing element MN1 201, the two current mirror devices MP1 401 and MP2 402, and the control element MN2 203.

If VREF is considered as perfect voltage source (in other words having zero impedance) then the loop gain A of the positive feedback loop can be given by:

$$A=(g_{MP2}\times g_{MN1})/[(g_{MP1}\times g_{MN2})(1+(g_{MP}\times R_L))] \quad \text{(iv)}$$

where:

$g_{MP2}$ is the trans-conductance of MP2 402;

$g_{MN1}$ is the trans-conductance of the sensing element MN1 201;

$g_{MP1}$ is the trans-conductance of MP1 401;

$g_{MN2}$ is the trans-conductance of the control element MN2 203;

$g_{MP}$ is the trans-conductance of the pass element MP 102;

$R_L$ is the value of the load $R_L$ 103; and the output impedances are ignored.

The trans-conductance of a device may be dependent on ratio of the device gate width (W) to gate length (L). If the W/L ratio of MP1 401 and MP2 402 are the same:

$$g_{MP1}=g_{MP2} \quad \text{(v)}$$

and for a wide output current range (up to few hundreds of mA):

$$g_{MP}\times R_L>>1 \quad \text{(vi)}$$

Taking (v) and (vi), the equation (iv) simplifies to:

$$A=g_{MN1}/g_{MN2} \quad \text{(vii)}$$

or the ratio of the trans-conductance of the sensing element 201 to the control element 203.

For the positive feedback loop to be stable, it is helpful to have a gain less than 1; namely, A<1, and the $g_{MN2}$ will be greater than $g_{MN1}$ to provide this. It will be appreciated that the trans-conductance of a device may be related to (at least in part) a gate width (W) to gate length (L) ratio of the device.

In some embodiments, the W/L of the sensing element MN1 201 to W/L of the control element MN2 may be slightly smaller than the W/L of MP1 to the W/L of MP2. In some embodiments this relationship may be selected so that $g_{MN2}>g_{MN1}$ and that the positive feedback loop is stable with A<1.

In other words the devices may be designed so the device ratios correspond to:

$$(W/L)_{MN1}/(W/L)_{MN2}=m*(W/L)_{MP1}/(W/L)_{MP2} \quad \text{(viii)}$$

where:

$(W/L)_{MN1}$ is the gate width to gate length ratio of MN1;

$(W/L)_{MN2}$ is the gate width to gate length ratio of MN2;

$(W/L)_{MP1}$ is the gate width to gate length ratio of MP1;

$(W/L)_{MP2}$ is the gate width to gate length ratio of MP2; and m<1 provides a stable positive feedback loop.

In some embodiments, the pass element MP 102 has a much larger (for example in the region of few hundred times) W/L ratio than the sensing element MN1 201.

The larger W/L ratio of the pass element MP 102 may result in a greater change in the current of the pass element MP 102 for a change in $V_{GS}$ than in the sensing element 201.

It will be appreciated that in the foregoing VREF has been assumed to be an ideal node with no impedance. In some embodiments, VREF may be provided as a buffered node in order to be a low impedance node.

If impedance (Rs) at VREF node is considered then equation (vii) modifies to:

$$A=(g_{MN1}/g_{MN2})+g_{MN1}*R_S \quad \text{(ix)}$$

For a stable system the gain A<1 and thus Rs should be sufficiently small to guarantee this.

In one example this requirement can be met if this node $V_{REF}$ is driven by a voltage buffer circuit. In another example a modified source follower may be used. It will however be appreciated that other techniques ensuring low impedance may be used to implement $V_{REF}$. Examples of implementations of the reference node will be discussed in relation to FIGS. 7 and 8.

Equations (iv) to (ix) consider the devices of the current mirror to have equivalent W/L ratios and the W/L ratios of the sensing device and the control device are set to for a stable loop gain. In other embodiments, the sensing and control devices may be considered to have equivalent sizes (for example W/L ratios) and the W/L ratios of the current mirror devices may be set for a stable loop gain. For example MP2 may be of a smaller size than MP1 in order to provide a loop gain of less than but close to 1.

Embodiments of the present application may provide on-chip voltage regulator 100 stability without an off-chip capacitor. Some embodiments may also provide a low output impedance at the regulated voltage node VOUT 104.

The output impedance of node Vout 104 may be a measure of the voltage regulation and the output impedance at Vout 104 may be related to the gain A of the positive feedback loop as described below. The device ratios may be selected for a value of A that provides stability as well as good voltage regulation.

The impedance at the regulated node Vout 104 to the first order may be given by:

$$R_{VOUT}=[(1/RL)+\{g_{MP}/(1-A)\}]^{-1} \quad \text{(x)}$$

where:

$R_{VOUT}$ is the output impedance of the regulated node Vout 104;

$R_L$ is the load;

$g_{MP}$ is the trans-conductance of the pass element MP 102; and

A is the positive loop gain.

As can be seen from (x) as A tends towards 1, the voltage regulation improves as the $R_{VOUT}$ decreases. There is therefore a trade-off between stability and voltage regulation since as A approaches 1 regulation becomes better while stability becomes poor.

In some embodiments, the device ratios (for example the gate width and lengths of the sensing and control elements) may be selected so that A is in the range of:

$$0.6<A<0.9 \quad \text{(xi)}$$

This may provide a compromise between the voltage regulation and the stability. In some embodiments MN1 201 and MN2 203 may be the same type of devices and proper layout can ensure a very precise setting of the loop gain across PVT variation.

Figure 5A:
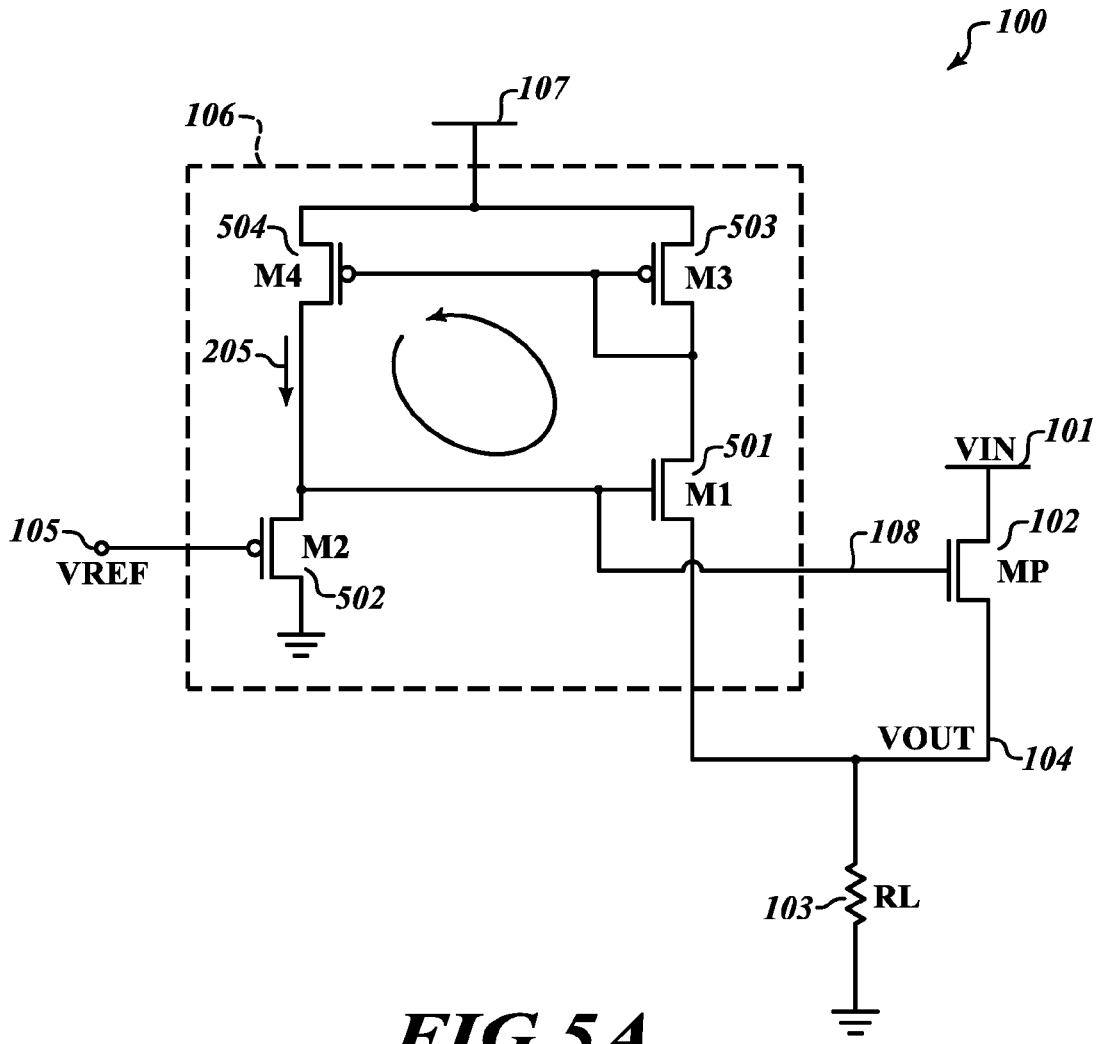
FIG. 5A is a circuit diagram of a voltage regulator according to a further embodiment.

FIG. 5A shows a further embodiment of the circuitry of block A 106 of FIG. 1. It will be appreciated that while the circuitry of block A 106 in the embodiment of FIG. 5A, this embodiment may provide an alternative example of a positive feedback loop and the device ratios of devices in this embodiment may be set to provide a gain A for stability similarly to that of the embodiment of FIG. 4.

In the embodiment of FIG. 5A, the reference load 105 need not be a low impedance note from the other figures.

It will be appreciated that like reference numerals in FIG. 5A depict like features.

The block 106 in FIG. 5A comprises a first MOSFET M1 501, a second MOSFET M2 502, a third MOSFET M3 503 and a fourth MOSFET M4 504. M1 501 may be an n-channel MOSFET, while M2, M3 and M4 may be p-channel MOSFETs.

A source terminal of M1 501 may be coupled to the output voltage $V_{OUT}$ 104 and a drain terminal of M1 501 may be coupled to a drain terminal of M3 503. A gate terminal of M1 501 may be coupled to a gate terminal of the pass element MP 102 as well as to a source terminal of M2 502.

Respective source terminals of M3 503 and M4 504 may be coupled to the supply voltage 107. Respective gate terminals of M3 503 and M4 504 may be coupled together. In addition, the gate and drain terminals of M3 503 may be coupled together.

The source terminal of M2 502 may further be coupled to the drain terminal of M4 504. A drain terminal of M2 502 made be coupled to ground with a gate terminal of M2 502 coupled to the reference voltage $V_{REF}$ 105. It will be appreciated that the configuration of M1 501 may be similar to that of the sensing element 201 in other embodiments. Additionally it will be appreciated that M3 503 and M4 504 may provide a current mirror.

FIG. 5A provides an alternative configuration for the sensing element, control element and current mirror of FIG. 4 and it will be appreciated that this embodiment works similarly to that of FIG. 4.

Figure 5B:
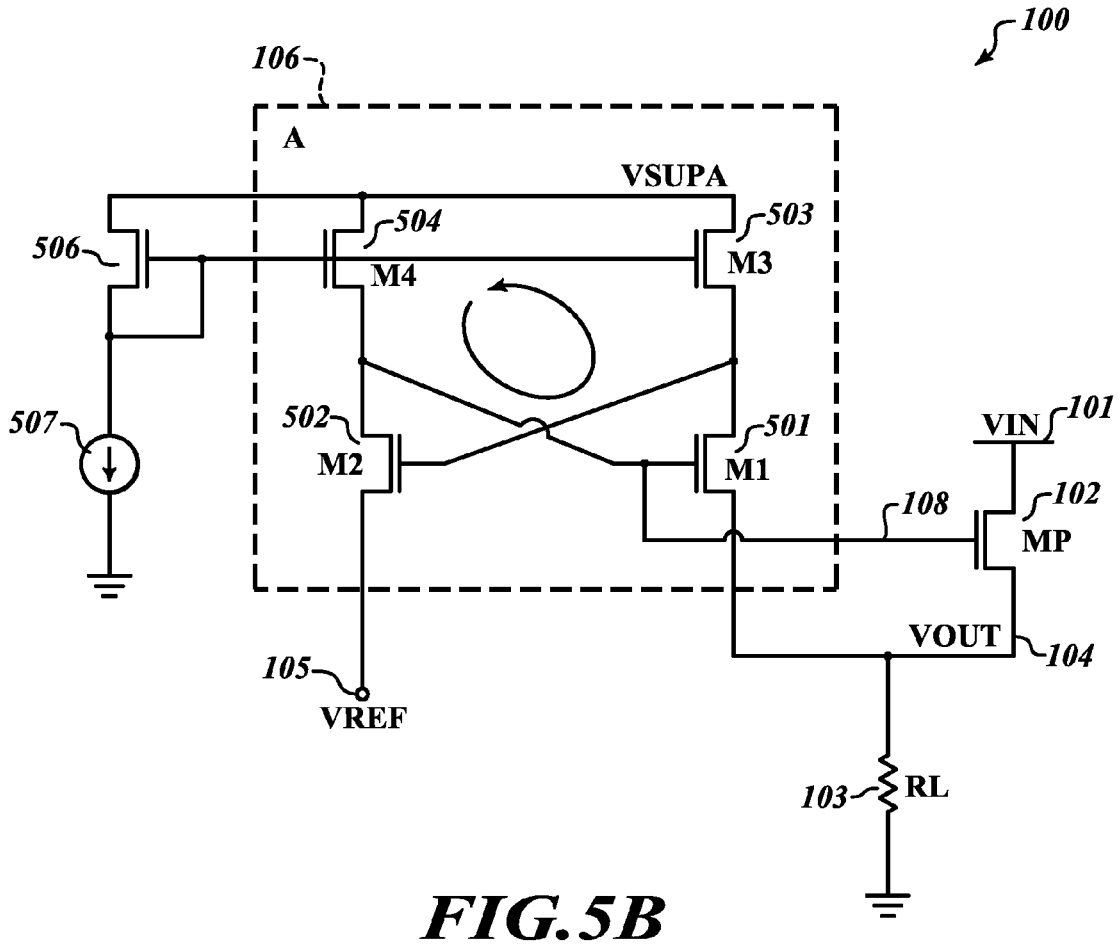
FIG. 5B shows a circuit diagram of a voltage regulator according to yet another alternative embodiment.

FIG. 5B shows yet another alternative embodiment for the implementation of block A. In FIG. 5B, another example is provided in which block A is connected to provide a positive feedback circuit. In this example, there is a translinear cross-quad circuit structure as shown in FIG. 5B. The current mirror for devices 503, 504 is provided from an additional device 506 which is coupled to a current source 507. The transistor 506 provides a current mirror signal to drive transistors 504, 503 rather than the arrangement shown in FIG. 5A. In addition, the transistors 502, 501 are cross-coupled, having the gate of transistor 501 coupled to the drain of transistor 502 and the gate of transistor 502 coupled to the drain of transistor 501. One significant feature of the circuit of FIG. 5B is that the loop gain is deliberately set to be less than one (1). This is done by ensuring that the transistors in the loop are not exactly matched and that the ratios have a loop gain resulting in less than one (1).

It will be appreciated that in the example circuitry of FIGS. 4 and 5, a sensing element senses a change in the regulated output voltage and feeds this information back to a control element in a positive feedback loop. The control element may control a pass element to adjust the regulated output voltage towards a reference voltage. The gain of the positive feedback loop may be adjusted by adjusting the W/L ratios of the devices in the positive feedback loop. In some embodiments the ratio of the W/L of the control element to the W/L of the sensing element may be controlled to provide a loop gain $A<1$. The loop gain may be selected to be less than 1 for stability but close to 1 for voltage regulation. In some embodiments the loop gain may be in the range of $0.6<A<0.9$.

It will be appreciated that while the equations determining loop gain have been laid out with specific reference to the embodiment of FIG. 4, similar equations may be applied to the embodiment of FIG. 5A.

As described above, in some embodiments, the reference voltage node $V_{REF}$ 105 may be implemented as a low voltage node. It will be appreciated that in some embodiments, for example the embodiment of FIG. 6, the $V_{REF}$ 105 need not be low impedance and the specific implementation of $V_{REF}$ is optional.

Figure 6:
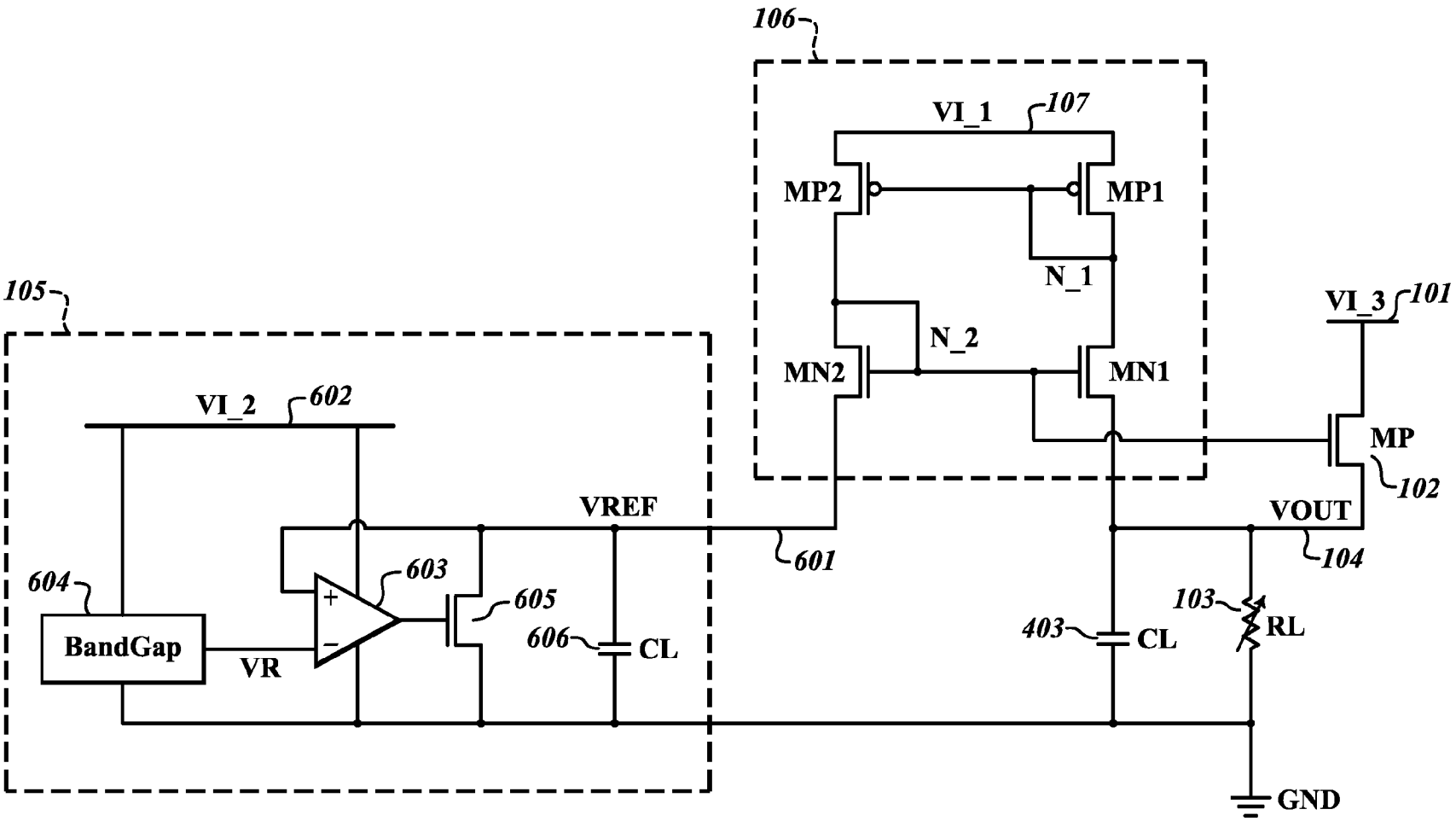
FIG. 6 is a circuit diagram of a reference voltage node according to one embodiment.
Figure 7:
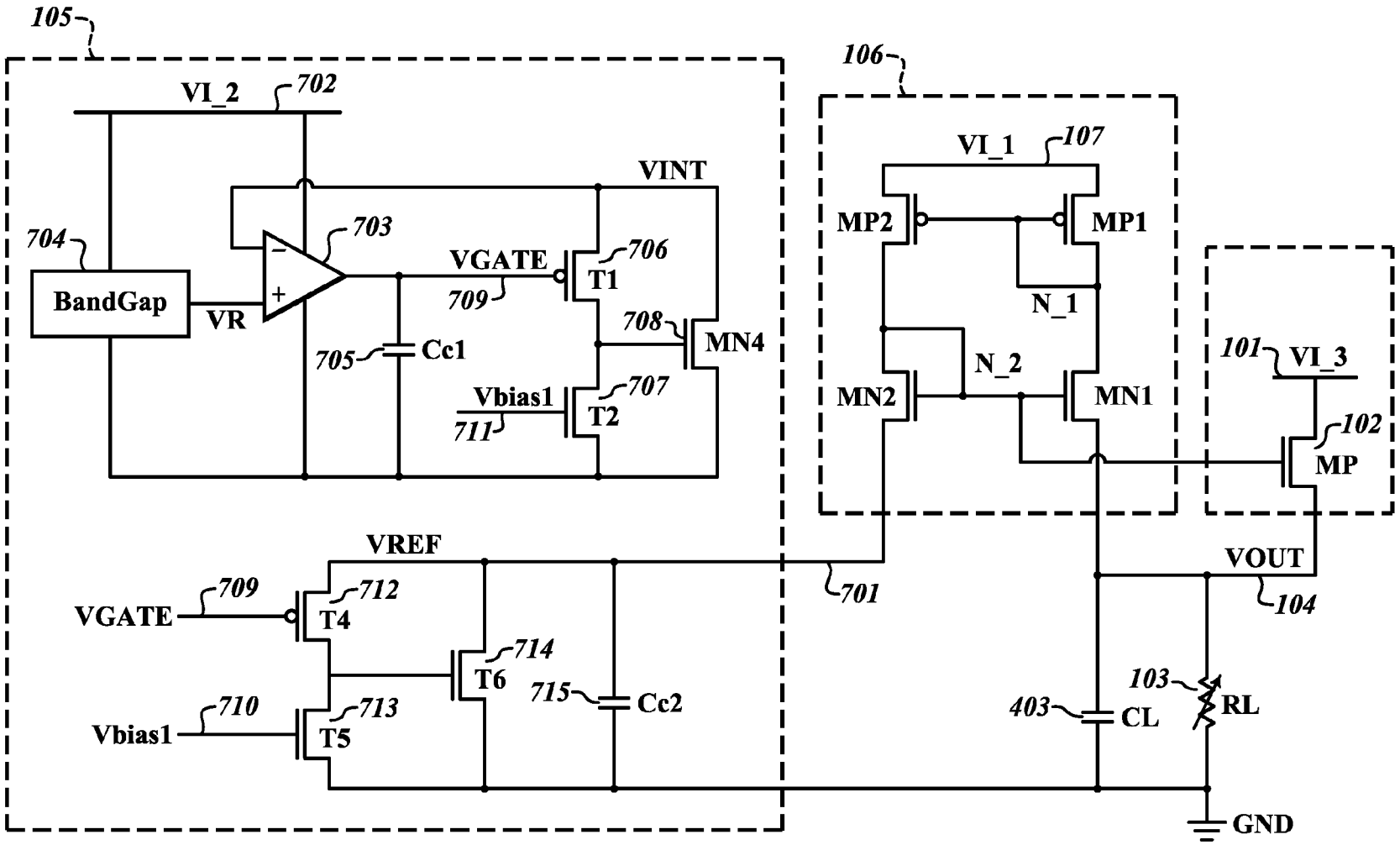
FIG. 7 is a circuit diagram of a reference voltage node according to a further embodiment.

FIGS. 6 and 7 show two examples of the implementation of $V_{REF}$ 105 as a low impedance node.

In these examples, the voltage regulator has been implemented for following specifications in CMOS055 technology: Input voltage range: 3.3V+/−10%; Output voltage range: 1.2V+/−100 mV; Maximum load current: 200 mA; Minimum CL: 5 nF. It will however be appreciated that these examples may be applicable to other or additional specifications.

FIG. 6 shows a first example of the reference voltage node 105.

FIG. 6 comprises block A 106, pass element 102, load 103 and capacitor $C_L$ 403. Block A 106 may be coupled to a first source voltage VI_1107. The pass element 102 may be coupled to a third voltage VI_3 101. Block A 106 may further be coupled to a voltage reference node $V_{REF}$ 105 via line 701.

While the circuitry of block A 106 has been depicted as being in line with that of the embodiment of FIG. 4, it will be appreciated that the circuitry of block A may be implemented according to a different embodiment, for example the embodiment of FIG. 5A or FIG. 5B.

$V_{REF}$ 105 may comprise a bandgap voltage reference circuit 604, an amplifier 603, an n-channel MOSFET 605 and a capacitor 606. $V_{REF}$ may be coupled to a second supply voltage VI_2 602.

The bandgap voltage reference circuit 604 may be coupled to the second supply voltage VI_2 602 and to ground. The bandgap voltage reference circuit 604 may provide a voltage reference VR to the inverting input of the amplifier 603.

A positive power supply terminal of the amplifier 603 may be coupled to the second voltage source VI_2 602 and a negative power supply terminal of the amplifier 603 may be coupled to ground. The non-inverting input of the amplifier 603 may be coupled to a drain terminal of the n-channel MOSFET 605. An output of the amplifier 603 may be coupled to a gate terminal of the n-channel MOSFET 605 and a source terminal of the n-channel MOSFET 605 may be coupled to ground.

The capacitor 606 may be coupled across the drain terminal and source terminal of the n-channel MOSFET 605. $V_{REF}$ 105 may be coupled to block A 106 at the drain terminal of the n-channel MOSFET 605 which is depicted at 601.

In the embodiment of FIG. 6, $V_{REF}$ 105 may be implemented as a voltage buffer circuit. The capacitor 606 may provide a compensation capacitance to support the stability of voltage buffer. In this embodiment, the capacitor may be in the order of tens of picofarads.

In operation, the bandgap voltage reference circuit 604 may receive the second supply voltage VI_2 602 and buffer it against changes in temperature. This voltage reference VR may be provided to the amplifier 603 which receives a feedback voltage $V_{REF}$ provided to block A 106. The difference between the voltage reference form the bandgap voltage reference circuit 604 and the feedback voltage $V_{REF}$ 601 is used to drive $V_{REF}$ 601 to VR. This may be carried out by controlling the gate terminal of the n-channel MOSFET 605 to adjust the drain terminal voltage of the MOSFET 605. In this manner a reference voltage node may have low impedance.

In this example, the voltage at the VI_1 107 may be sufficiently higher (for example greater than 1V) than the voltage at $V_{OUT}$ 104. This may be in order to bias the transistors in block A. The voltage provided to the pass element VI_3 101 and the voltage provided to the reference node VI_2 602 may be marginally higher than the output voltage $V_{OUT}$ 104 (for example greater than 200 mV higher). This slightly higher voltage may account for the voltage drop across devices.

FIG. 7 shows a second embodiment of a low impedance voltage reference node.

FIG. 7 comprises block A 106, pass element 102, load 103 and capacitor 403. It will be appreciated that while the circuitry of block A 106 has been depicted as being that of the example FIG. 4, other circuitry may be used. Block A 106 may be coupled to a voltage reference node 105 at coupling 701.

The reference node 105 comprises a second voltage supply VI_2 702, a bandgap voltage reference 704, an amplifier 15443, a first capacitor 705, a first transistor T1 706, a second transistor T2 707, a third transistor T3 708, a fourth transistor T4 712, a fifth transistor T5 713, a sixth transistor T6 714 and a second capacitor 715.

T1 706 and T4 712 may be p-channel MOSFETs while T2 707, T3 708, T5 713 and T6 714 may be n-channel MOSFETs.

The bandgap voltage reference circuit 704 may be coupled to the second voltage supply VI_2 702 and to ground. The bandgap voltage reference circuit 704 may provide a reference voltage VR to an inverting input of the amplifier 703. A positive voltage supply of the amplifier may be coupled to the second voltage supply VI_2 702 and a negative voltage supply of the amplifier may be coupled to ground.

An inverting input of the amplifier 703 may be coupled to a source terminal of T1 706 and an output of the amplifier 703 may be coupled to a gate terminal of T1 706 via gate voltage $V_{GATE}$ 709. The first capacitor 705 may be coupled between the output of the amplifier 703 and ground.

A drain terminal of T1 706 may be coupled to a drain terminal of T2 707. A source terminal of T2 707 may be coupled to ground and a gate terminal of T2 707 may be coupled to a bias signal $V_{bias1}$ 711. The drain terminal of T2 707 may be further couple to a gate terminal of T3 708. A source terminal of T3 708 may be coupled to ground and a drain terminal of T3 708 may be coupled to the source terminal of T1 706.

$V_{GATE}$ 709 may be further provided to a gate terminal of T4 712. The second capacitor 715 may be coupled between a source terminal of T4 712 and ground. A drain terminal of T4 712 may be coupled to a drain terminal of T5 713 and to a gate terminal of T6 714. A gate terminal of T5 713 may be coupled to the bias signal $V_{bias1}$ 710. A source terminal of T5 713 may be coupled to ground. A drain terminal of T6 714 may be coupled to the source terminal of T4 712 and a source terminal of T6 714 may be coupled to ground.

The source terminal of T4 and drain terminal of T6 714 may be coupled to the block A 106 and provide a reference voltage $V_{REF}$ on line 701.

In the embodiment of FIG. 7, the $V_{REF}$ node 105 is realized through a super source follower (SSF) comprising the transistors T4 712, T5 713 and T6 715. This SSF may be biased through a replica super source follower comprising T1 706, T2 707 and T3 708. The first and second capacitors 705 and 715 may be provided as compensation capacitors In this embodiment, the compensation capacitance required to achieve a low impedance value for the voltage node $V_{REF}$ 105 may be small. In some examples the capacitance of this embodiment may be 50% smaller than other implementations of the node. A smaller capacitance may lead to a smaller required area.

It will be appreciated that the implementations of FIGS. 6 and 7 are example implementations only and other implementations may be used in embodiments. For example, a low impedance $V_{REF}$ 105 may also be realized through several other techniques such as various variants of source followers, flipped source followers, various variants of voltage buffers etc.

FIGS. 8 to 12 shows simulation results of a comparison between an example of a voltage regulator according to an embodiment of the present application and an ideal voltage source, and PMOS based regulator.

In the comparison, the ideal voltage source has the following characteristics:

10 nH boding wire inductance 100 mOhm bonding wire resistance 5 nF on-chip capacitance The PMOS based conventional voltage regulator has the following characteristics:

10 nH boding wire inductance 100 mOhm bonding wire resistance 2 uF off-chip capacitor 5 nF on-chip capacitance The example of an on-chip voltage regulator according to an inventive embodiment has the following characteristic:

5 nF on-chip capacitance

FIGS. 8 to 12 plot the computer simulated regulated output voltage against time and the load current against time for the three different voltage regulators.

Figure 8:
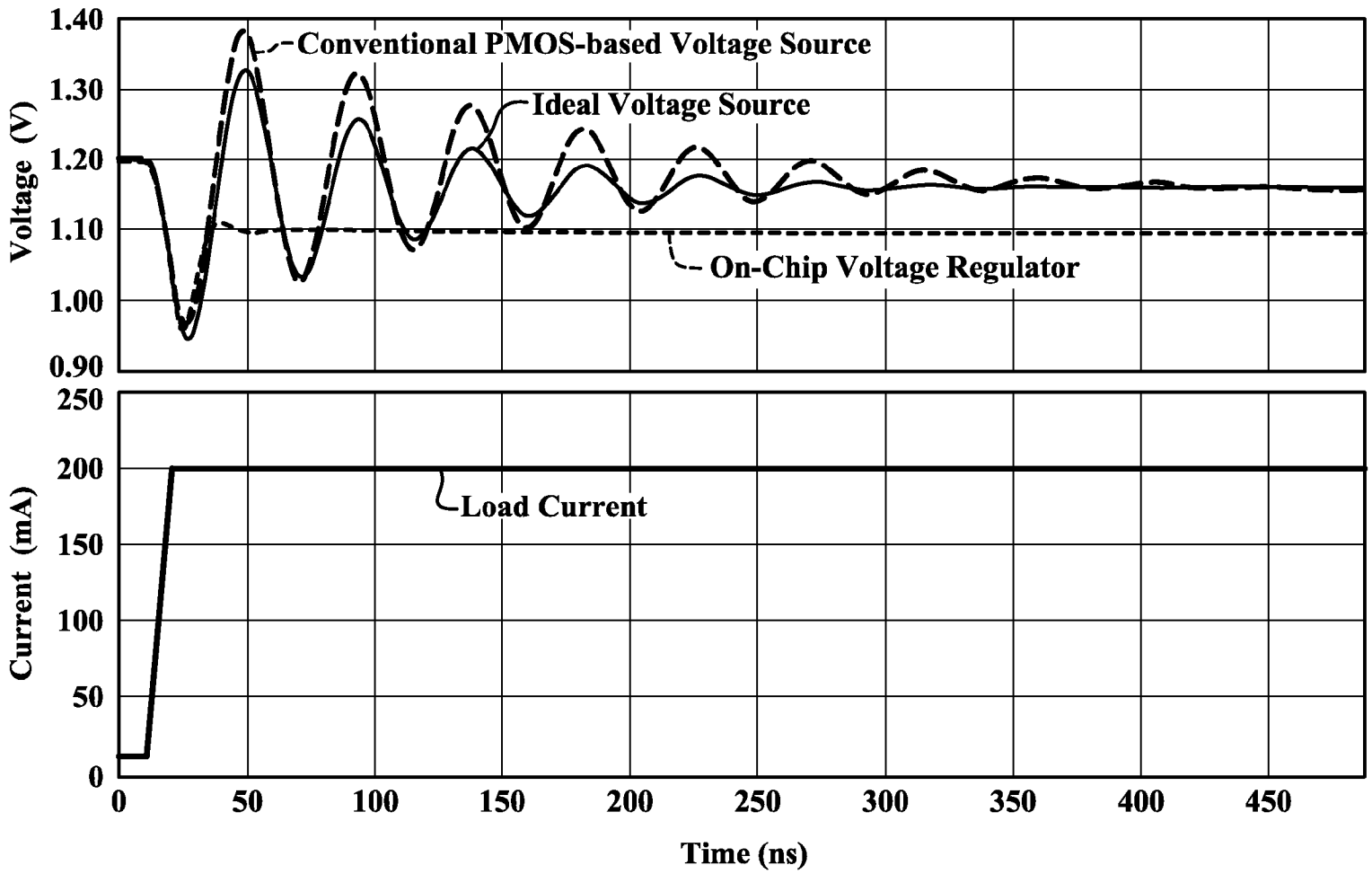
FIGS. 8 to 12 are signal diagrams showing a comparison of the behavior of an embodiment with other voltage regulators.

FIG. 8 shows the behavior of the regulators in the comparison when the load current rises from 10 mA to 200 mA in 10 ns. In the graph of FIG. 8, the load current is shown rising from approximately 0 mA to 200 mA over a short timeframe, in the range of less than 10 ns. After the load current reaches 200 mA, it remains stable for the remainder of the graph in FIG. 8. Shown above the load current in FIG. 8 is the output voltage as simulated for the three different types of circuits, a conventional PMOS voltage source of the type used in the prior art, an ideal voltage source, and the inventive on-chip voltage regulator of the type described and shown herein within respect to FIGS. 1-7. As can be seen, the inventive on-chip voltage regulator briefly dips from 1.2V to just less than 1V at the instant of the rise and then, at less than 50 ns, has stabilized at 1.1V and remains stable at 1.1V for the entire operation.

Figure 9:
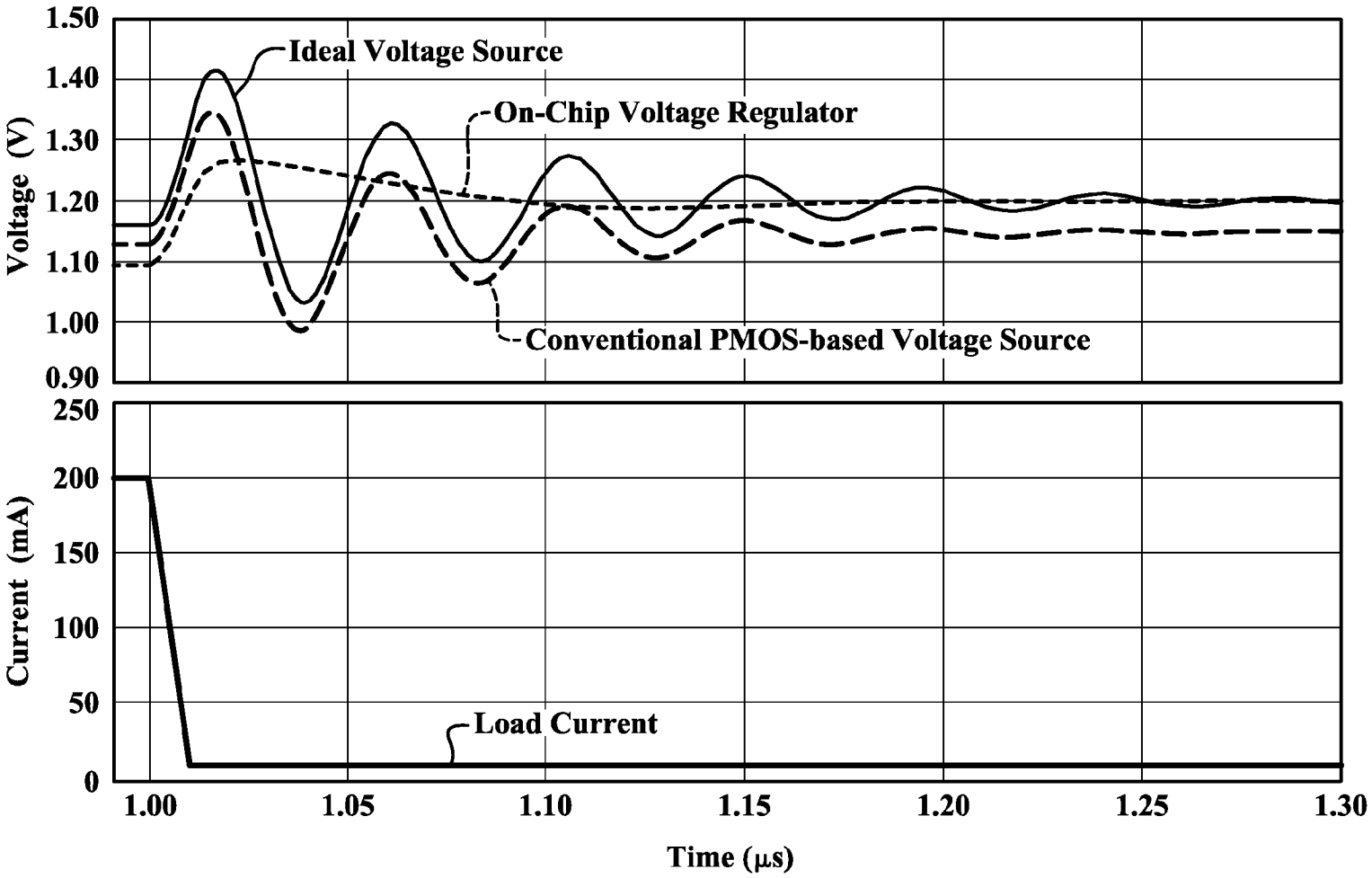

FIG. 9 shows the behavior of the regulators in the comparison when the load current drops from 200 mA to 10 mA in 10 ns. As can be seen in the graph of FIG. 9, when the load current drops from 200 mA to approximately 0 mA in 10 ns, the three different voltage sources respond differently. The ideal voltage source rises quickly, as does the conventional prior art voltage source. However, the inventive on-chip voltage regulator has a slight rise and then quickly stabilizes at 1.2V.

Figure 10:
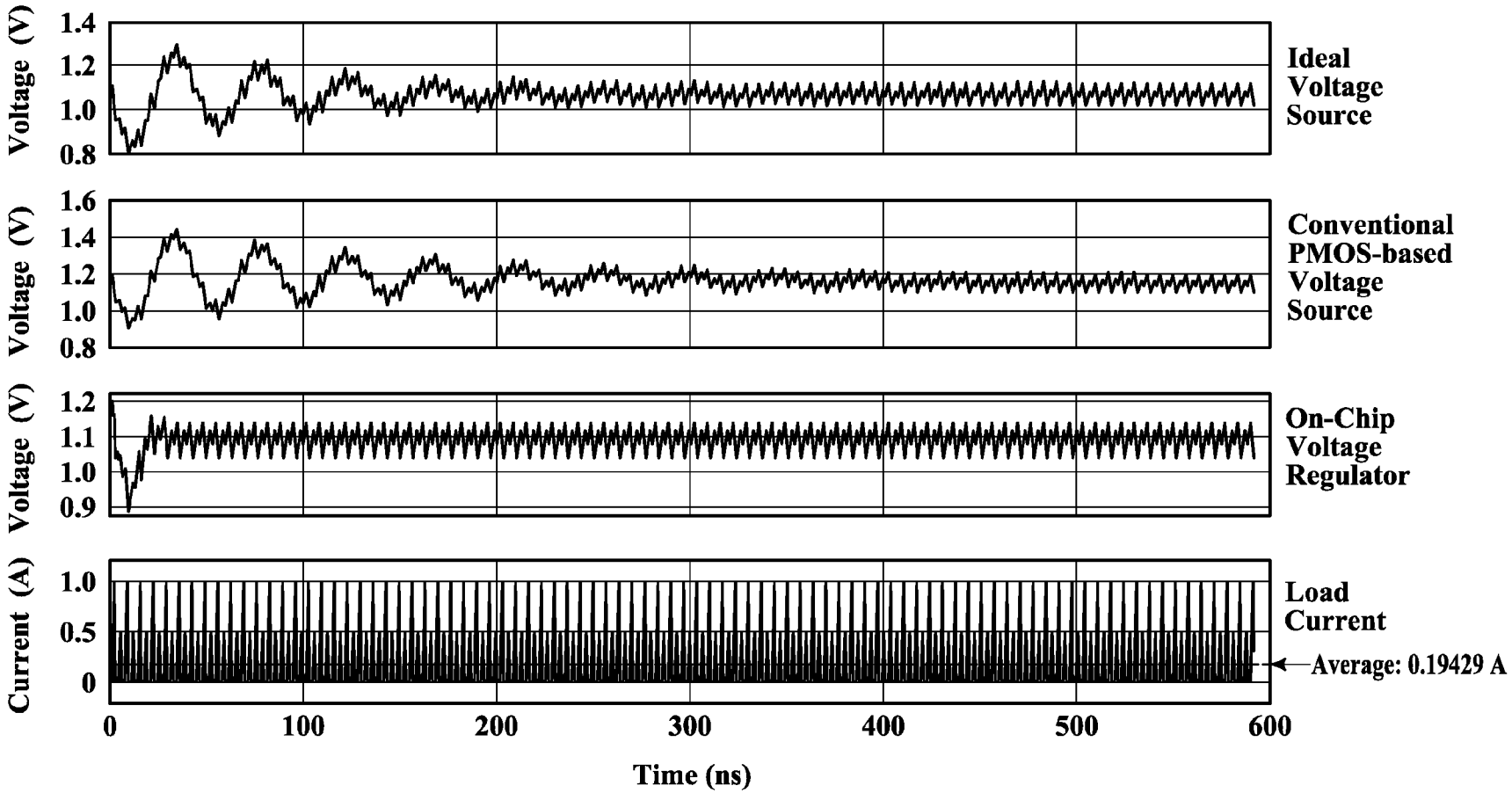

FIG. 10 shows the behavior of the regulators in the comparison with a 150 MHz load current. As can be seen, when the current fluctuates with a frequency of about 150 MHz, the ideal voltage source and the conventional prior art voltage source take significant time to settle out and begin to match the frequency of the load current. The on-chip voltage regulator as described herein is able to quickly match the frequency changes in the load current, and keep the output voltage relatively stable at approximately 1.1V with deviations of less than a few percent from the target regulated voltage of 1.1V.

Figure 11:
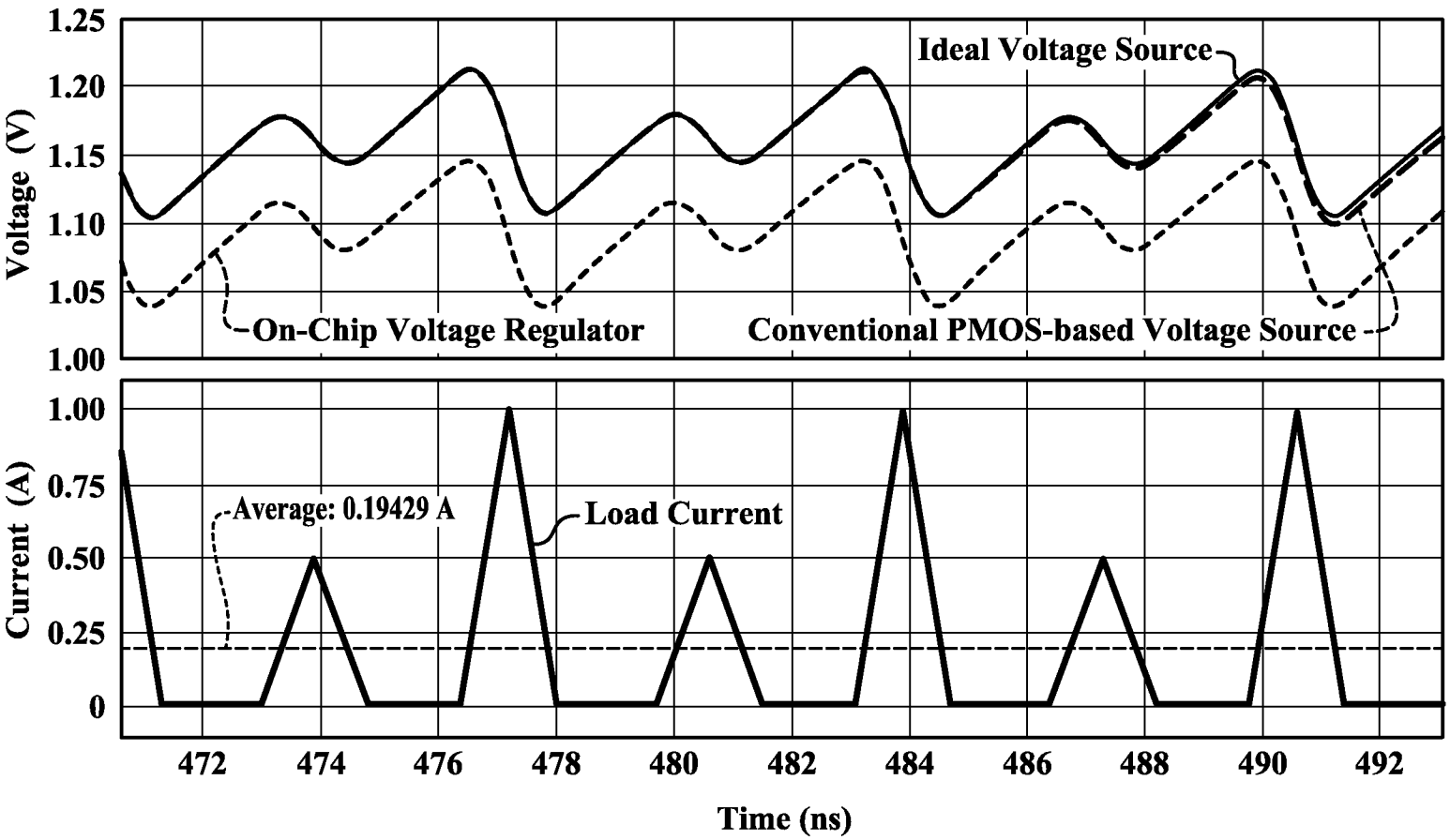

FIG. 11 shows the behavior of the regulators in the comparison with a 150 MHz load current on a smaller scale.

Figure 12:
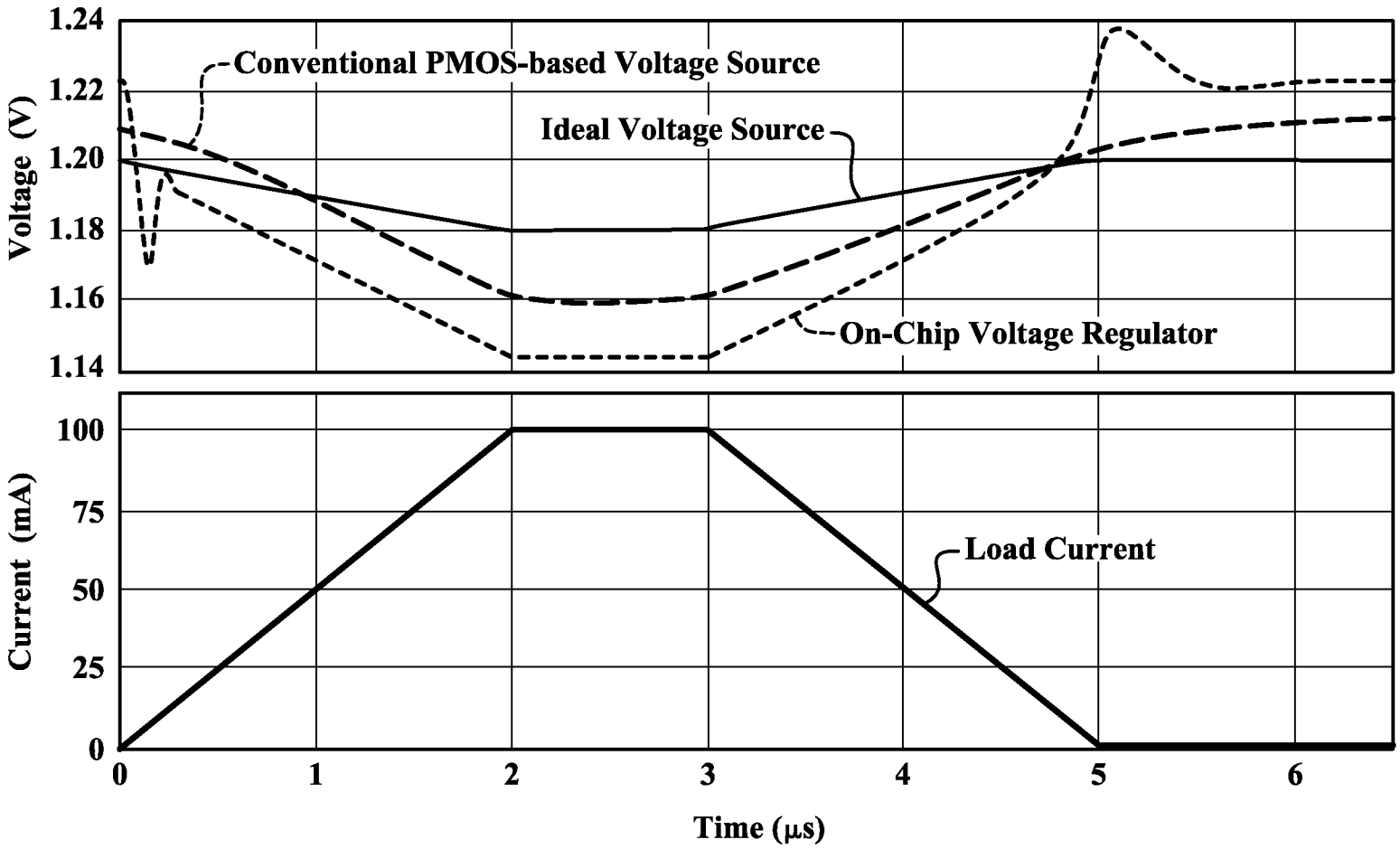

FIG. 12 shows the behavior of the regulators in the comparison when the load current rises from 0 mA to 200 mA in 2 μs.

In some embodiments, a voltage regulator 106 may be provided without a replica bias architecture. The voltage regulator may implement a positive feedback loop for the sensing and control of the regulated output voltage. A negative feedback loop may therefore be avoided in the regulator. The voltage regulation in some embodiments may be controller by the positive feedback loop. Some embodiment may provide a lower voltage headroom requirement than other implementation of a voltage regulator. This may be due in some embodiments to no replica NMOS being implemented in the feedback circuit. In some embodiments stability may be ensured by making positive feedback circuit's loop gain <1. In these embodiments stability may be dependent on device ratios and not on a capacitor value. In some embodiments, an off-chip capacitor may be negated.

Figure 13:
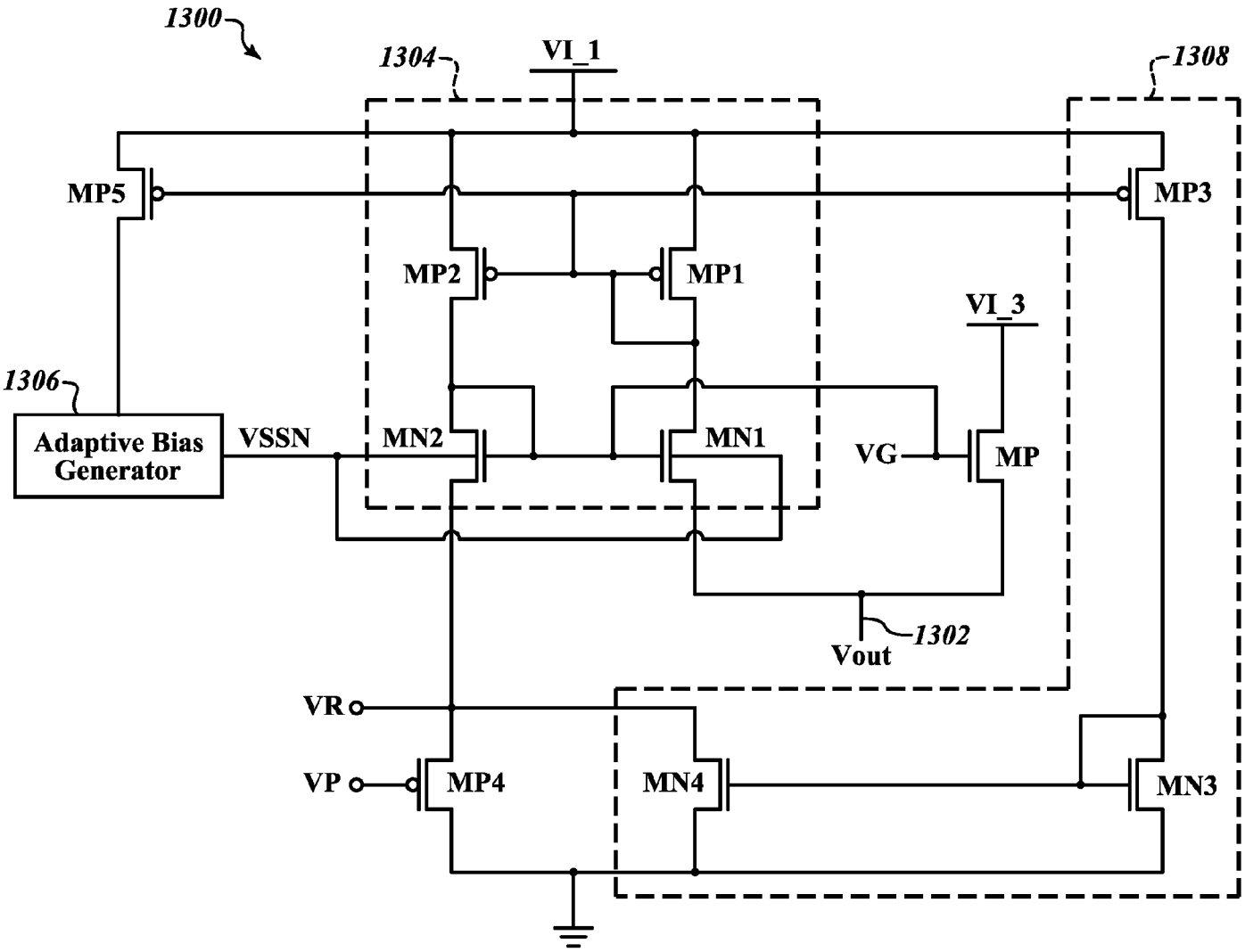
FIG. 13 is a schematic diagram of a voltage regulator including a loop current adaptor according to one embodiment.

FIG. 13 is a schematic diagram of a low voltage regulator 1300, according to one embodiment. The voltage regulator 1300 includes an output node 1302, a pass transistor MP coupled to the output node, a feedback loop 1304 coupled to the pass transistor MP and the output node, and an adaptive bias generator 1306.

The voltage regulator 1300 supplies a regulated output voltage Vout and an output current to a load via the output node 1302. The output current is passed to the output node via the pass transistor MP, whose source terminal is coupled to the output node.

The feedback loop 1304 regulates the output voltage Vout based on a reference voltage VR. The feedback loop includes NMOS transistors MN1, MN2 and PMOS transistors MP1, MP2. The transistor MN1 generates a first loop current based on the output current in the transistor MP. In particular, the source and gate terminals of the transistors MP, MN1 are coupled together. Because the transistors MN1, MP have the same gate to source voltage ($V_{GS}$), the first loop current in MN1 is proportional to the output current in the transistor MP, in accordance with the respective threshold voltages and width to length ratios of MN1, MP. The drain terminal of the transistor MP1 is coupled to the drain terminal of the transistor MP1. The transistor MP1 therefore also passes the first loop current. The drain terminal of the transistor MP1 is also coupled to the drain terminal of the transistor MP1, by which voltage on the gate terminal of the transistor MP1 is driven to that value which will cause the transistor MP1 to pass the first loop current. The transistor MP2 is in a current mirror configuration with MP1 and will pass a second loop current based on the first loop current in accordance with the respective width to length ratios of MP1 and MP2. The drain terminal of the transistor MN2 is coupled to the drain terminal of the transistor MP2. The transistor MN2 therefore passes the second loop current from MP2. The gate and drain terminals of the transistor MN2 are coupled together, as well as to the gate terminals of the transistors MN1, MP. However, because the source terminal of the transistor MN2 is coupled to a reference voltage VR, if VR is different than Vout, then voltage on the gate terminal of MN2 will increase or decrease until Vout is driven to the same voltage as VR. In this way, the feedback loop regulates the output voltage Vout based on the reference voltage VR.

However, in cases of very small or very large load currents, various problems can occur if other measures are not taken. In particular, at 0 load current the loop currents could be very small, while at high load currents the loop currents could be very large. In these extreme cases there may be too much leakage current or too low speed in the low voltage regulator if other measures are not taken.

Thus, in order to further improve the operation of the low voltage regulator 1300 in cases of high or low output currents, the low voltage regulator includes the adaptive bias generator 1306. The adaptive bias generator 1306 functions to adapt the ratio of the loop currents to the output current so that the loop currents stay within a selected range in which the speed and leakage of the low voltage regulator are at acceptable levels. As the output current drops to lower levels, the adaptive bias generator increases the ratio of the loop currents to the output current so that the operating current does not drop to an undesirably low level. As the load current increases to higher levels, the adaptive bias generator reduces the ratio of the loop currents to the output current so that the operating current does not increase to an undesirably high level. In this way the output current is adapted to maintain desirable functionality of the low voltage regulator in extreme cases.

The adaptive bias generator adapts the ratio of the loop current to the load current by applying a back gate bias voltage VSSN to the transistors MN1, MN2. The back gate bias voltage affects the threshold voltages of the transistors MN1, MN2, which in turn affects the drain current in the transistors MN1, MN2 for a given $V_{GS}$. At low load currents, the adaptive bias generator adjusts the back gate bias voltage to a higher level, thereby decreasing the threshold voltage of the transistors MN1, MN2 and increasing the loop current for a given $V_{GS}$ of MN1, MN2. At high load currents, the adaptive bias generator adjusts the back gate bias voltage to a lower level, thereby increasing the threshold voltages of the transistors MN1, MN2 and decreasing the loop currents for a given $V_{GS}$ of MN1, MN2. In this way the adaptive bias generator adapts the ratio of the loop currents to the load current.

In one embodiment, the voltage regulator further includes a current subtractor 1308 that helps to make the output node 1302 a low impedance node by subtracting a portion of the current that flows from the transistor MN2. In particular, the current subtractor 1304 passes a portion of the current from MN2 through the transistor MN4 based on the width to length ratios of MP3 and MP1 and the width to length ratios of MN3 and MN4. In particular, the transistor MP3 is in a current mirror configuration with MP1 and will pass a current proportional to the current through MP1 based on the width to length ratio of MP1 and MP3. The transistor MN3 passes the same current MP3. Because the drain terminal of the transistor MN3 is coupled to the gate terminal of the transistor MN3, the gate voltage on the transistor MN3 is driven to that voltage which provides a $V_{GS}$ that will pass the current from MP3. The transistor MN4 is in a current mirror configuration with MN3 and will pass a current proportional to the current through MN3 based on the width to length ratios of MN3 and MN4. Thus, the current subtractor 1308 passes a portion of the current from MN2 through MN4. The remainder of the current from MN2 is passed through the transistor MP4 based on control voltage VP supplied to the gate terminal of the transistor MP4. In this way, the current subtractor 1308 can help make the output node 1302 a low impedance node.

Figure 14:
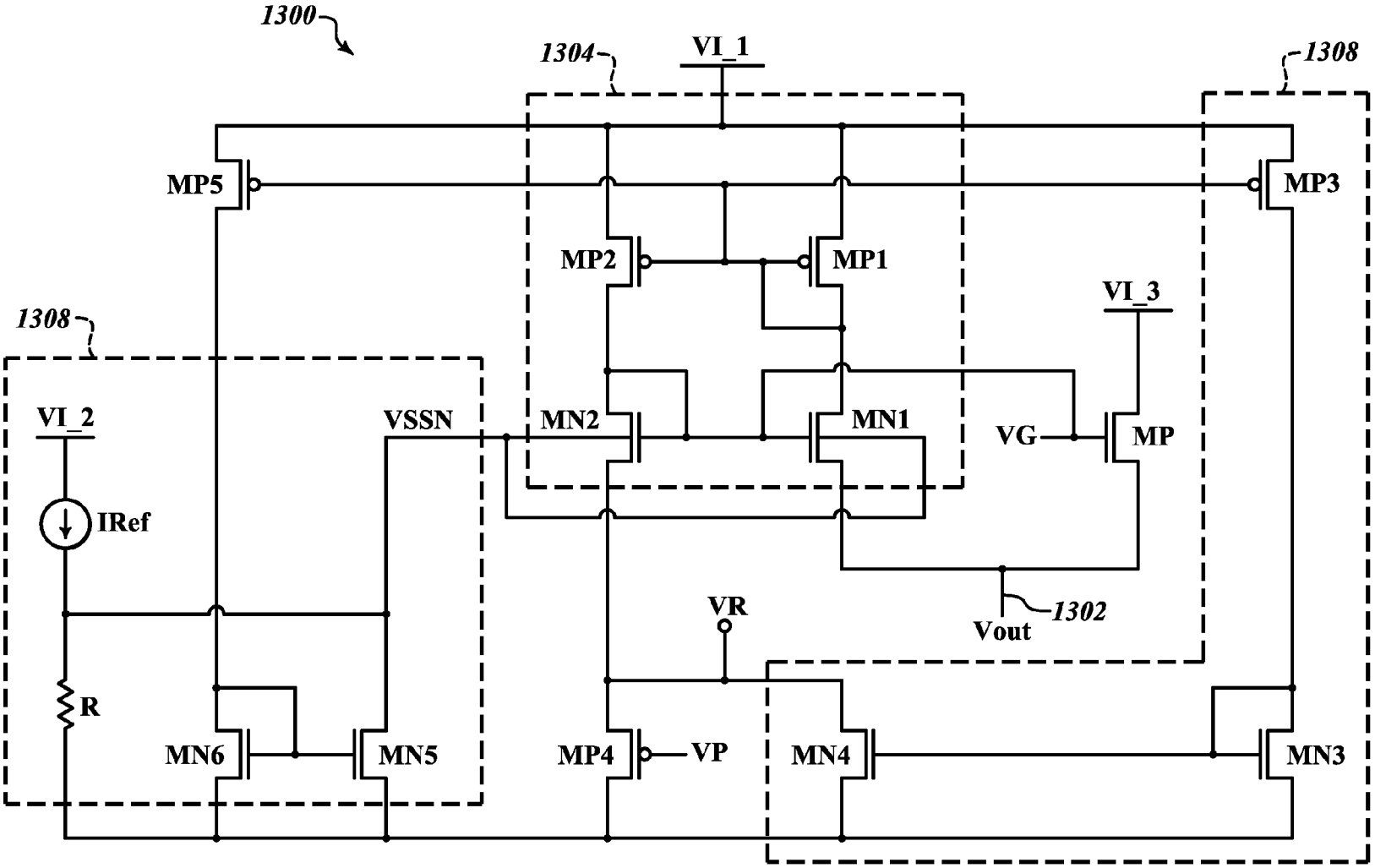
FIG. 14 is a schematic diagram of a voltage regulator including a loop current adaptor, according to a further embodiment.

FIG. 14 is a schematic diagram of a low voltage regulator 1300 including an adaptive bias generator 1308, according to one embodiment. The adaptive bias generator 1308 includes a reference current generator Iref that generates a reference current. A resistor R is positioned between the reference current generator Iref and ground. A transistor MN5 is positioned between the reference current generator Iref and ground. A transistor MN6 is positioned between MP5 and ground. The gate terminal of the transistor MN6 is coupled to the drain terminal of the transistor MN6. The gate terminal of the transistor MN6 is also coupled to the gate terminal of the transistor MN5.

The adaptive bias generator 1308 generates the back gate bias voltage VSSN based on a comparison of the current passing through MP1 to the reference current. The back gate bias voltage VSSN is equal to the voltage drop across the resistor R and is thus proportional to the current flowing through the resistor R. The current flowing through the resistor R is the difference between the reference current and the current flowing through MP5, which is in turn based on the current in MP1. Thus, the back gate bias voltage is based on a comparison of the current in MP1 and the reference current.

More particularly, the adaptive bias generator 1302 compares the current in MP1 to the reference current by utilizing the transistor MN5 and MN6. The transistor MN6 is coupled to the transistor MP5 and will pass the current from MP5. The gate and drain terminals of MN6 are coupled to together, by which the gate voltage of MN6 is driven to a value that will pass the current from MP5. The transistor MN5 is in a current mirror relationship with MN6 and will pass a current based on the current in MN6 according to the respective width to length ratios of MN5, MN6. A portion of the reference current will flow through the transistor MN5, based on the current in MP5, and the remainder of the current in MN5 will flow through the resistor R. As the current in MP1 increases, the current flowing through MP5 and MN6 will increase, thereby increasing the current flowing through MN5. As the current in MN5 increases, a greater portion of the reference current passes through MN5 while a smaller portion of the reference current passes through the resistor R. As the current in MN5 decreases, a smaller portion of the reference current passes through MN5 while a greater portion of the reference current passes through the resistor R. The back gate bias voltage VSSN is the same as the voltage drop across the resistor R. As the current in MP1 increases, the back gate bias voltage VSSN decreases. As the current in MP1 decreases, the back gate bias voltage VSSN increases. Thus, the adaptive bias generator 1302 generates the back gate bias voltage based on a comparison between the loop current and the reference current generated by the reference current generator Iref.

Those of skill in the art will recognize, in light of the present disclosure, that many other schemes can be implemented to generate a back gate bias voltage in accordance with principles of the present disclosure; all such schemes fall within the scope of the present disclosure.

Figure 15:
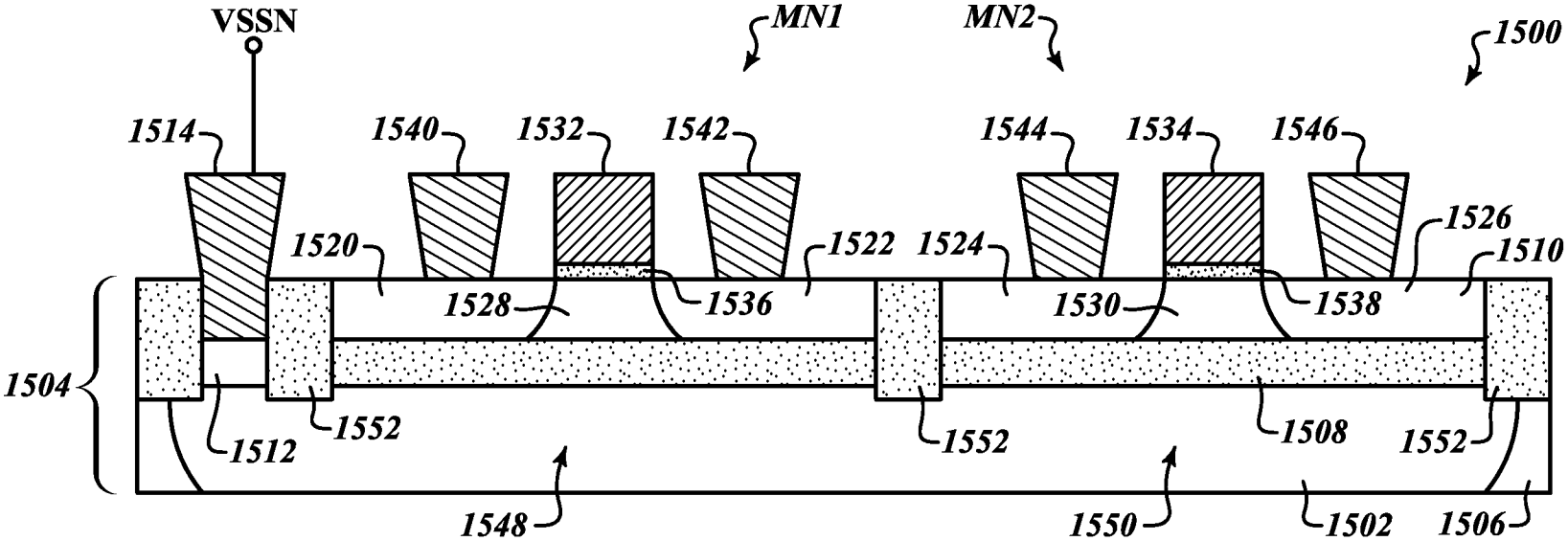
FIG. 15 is a cross section of an integrated circuit die, according to one embodiment.

FIG. 15 is a cross section of an integrated circuit die 1500 in which the low voltage regulator of FIG. 14 is implemented. The integrated circuit die includes a fully depleted silicon on insulator (FDSOI) semiconductor substrate 1504, according to one embodiment. The FDSOI substrate 1504 includes a first layer of semiconductor material 1507, a buried oxide layer (BOX) 1508 directly on top of the first layer of semiconductor material 1507, and a second layer of semiconductor material 1510 directly on top of the BOX layer 1508. A doped well region 1502, for example lightly doped with P-type donor atoms, is formed in the first layer of semiconductor material 1507. A highly doped body contact 1512 is positioned on the doped well region 1502. A body contact plug 1514 is coupled to the highly doped body contact region 1512, by which the back gate bias voltage VSSN can be applied to the doped well region 1502.

The NMOS transistors MN1 and MN2 of FIG. 14 are formed in conjunction with the FDSOI semiconductor substrate 1504. N-type source and drain regions 1520, 1522 of the transistor MN1 are formed in the second layer of semiconductor material 1510. N-type source and drain regions 1524, 1526 of the transistor MN2 are formed in the second layer of semiconductor material 1510. A channel region 57 of the transistor MN1 is positioned between the source and drain regions 1520, 1522 in the second layer of semiconductor material 1510. A channel region 1530 of the transistor MN2 is positioned between the source and drain regions 1524, 1526 in the second layer of semiconductor material 1510. A gate dielectric 1536 of the transistor MN1 is positioned over the channel region 1528. A gate electrode 1530 of the NMOS transistor MN1 is positioned on the gate dielectric 1536. A gate dielectric 1538 of the transistor MN2 is positioned on the channel region 1530. A gate electrode 1534 of MN1 transistor is positioned on the gate dielectric 1536. Source and drain contact plugs 1538, 1540 are positioned on the source and drain regions 1520, 1522. Source and drain contact plugs 1544, 1546 are positioned on the source and drain regions 1524, 1526 of the transistor MN2. The body regions 1548, 1550 of the transistors MN1, MN2 are positioned in the first layer of semiconductor material 1507, and more particularly within the doped well region 1502. Trench isolation regions 1552, for example of silicon dioxide, are positioned in the FDSOI substrate 1504.

In one embodiment, the first layer of semiconductor material 1507 is monocrystalline silicon between 10 and 1502 nm thick. The BOX layer 38 is silicon dioxide between 10 and 25 nm thick. The second layer of semiconductor material 1510 is monocrystalline silicon between 5 and 8 nm thick. Alternatively, other semiconductor materials and dielectric materials can be used for the first and second layers of semiconductor material 1507, 1510 and the BOX layer 1508.

Because the second layer of semiconductor material 1510 is very thin, the entire thickness of the second layer of semiconductor material 1510 in the channel regions 1524 and 1528 becomes fully depleted when the transistors MN1, MN2 are enabled. Thus, the body regions 1548, 1550 of the transistors MN1, MN2 are positioned in the doped well region 1502.

The body regions 1548, 1550 correspond to the back gates of the transistors MN1, MN2. Because the BOX layer 1508 is so thin, a voltage applied to the body regions 1548, 1550 will electrically affect the channel regions 1528, 1530, by which the threshold voltages of the transistors MN1, MN2 are also affected. In this way, the doped well region acts as a back gate to the transistors MN1, MN2. Application of the body bias voltage VSSN to the doped well region 1502 adjusts the threshold voltages of the transistors MN1, MN2. By adjusting the threshold voltages of the transistors MN1, MN2, the magnitude of the currents flowing in MN1, MN2 for a given $V_{GS}$ will also be adjusted. Thus, by adjusting the back gate voltage VSSN, the ratio of the load current to the currents in MN1, MN2 can be adapted.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An integrated circuit die comprising:
   - an FDSOI semiconductor substrate including:
     - a first layer of semiconductor material;
     - a buried dielectric layer positioned on the first layer of semiconductor material; and
     - a second layer of semiconductor material positioned on the buried dielectric layer;
   - an output node that supplies an output voltage;
   - an output transistor that supplies an output current to the output node;
   - a feedback loop coupled to the output transistor, wherein the feedback loop regulates the output voltage by generating a loop current based on the output current, the feedback loop including a first loop transistor having a control gate and a back gate, the back gate of the first loop transistor being implemented in the first layer of semiconductor material; and
   - an adaptive bias generator coupled to the feedback loop, wherein the adaptive bias generator applies a back gate bias voltage to the back gate of the first loop transistor and adapts a ratio of the loop current and the output current by adjusting the back gate bias voltage based on the output current.

2. The integrated circuit die of claim 1 wherein the control gate of the first loop transistor is positioned above the second layer of semiconductor material.

3. The integrated circuit die of claim 2 wherein the feedback loop includes a second loop transistor having a control gate coupled to the control gate of the first loop transistor and a back gate coupled to the back gate of the first loop transistor.

4. The integrated circuit die of claim 3 wherein the output transistor has a control gate coupled to the control gates of the first and second loop transistors.

5. The integrated circuit die of claim 4 wherein the adaptive bias generator compares the loop current to a reference current and generates the back gate bias voltage based on the comparison between the loop current and the reference current.

6. The integrated circuit die of claim 5 wherein the adaptive bias generator receives a mirrored current based on the loop current and compares the loop current to the reference current by comparing the mirrored current to the reference current.

7. The integrated circuit die of claim 3 wherein the first loop transistor has a source terminal coupled to the output node and the second loop transistor has a source terminal coupled to a reference voltage generator.

8. The integrated circuit die of claim 7 comprising a current subtractor coupled to the source terminal of the second loop transistor and configured to pass a portion of the loop current.

9. The integrated circuit die of claim 1 wherein the feedback loop is a positive feedback loop having a gain less than 1.

10. The integrated circuit die of claim 1 including a capacitor coupled between the output node and ground.

11. A method comprising:

passing a load current through an output transistor to an output node; and regulating an output voltage on the output node by;

supplying a reference voltage to a feedback loop coupled to the output transistor;

generating a loop current in the feedback loop based on the load current;

applying a back gate bias voltage to a back gate of a first loop transistor of the feedback loop; and adapting a ratio of the loop current and the load current by adjusting the back gate bias voltage based on the loop current.

12. The method of claim 11 comprising:

comparing the loop current to a reference current; and adapting the back gate bias voltage based on the comparison between the loop current and the reference current.

13. The method of claim 12 wherein comparing the loop current to the reference current includes comparing the reference current to a mirrored current based on the loop current.

14. The method of claim 13 comprising applying the back gate bias voltage to a back gate of a second loop transistor of the feedback loop.

15. The method of claim 14 wherein the first and second loop transistors are NMOS transistors.

16. The method of claim 15 comprising:

generating the loop current with the first loop transistor; and regulating the output voltage with the second loop transistor.

17. The method of claim 16 wherein a control gate of the first loop transistor is coupled to a control gate of the second loop transistor.

18. The method of claim 15 wherein adapting the back gate bias voltage includes:

increasing the back gate bias voltage as the loop current decreases; and decreasing the back gate bias voltage as the loop current increases.

19. A device comprising:

an output node that supplies an output voltage;

an output transistor that passes a first current to the output node;

a reference voltage node that outputs a reference voltage;

a feedback loop coupled to the output node and the reference voltage node and that generates a second current based on the first current and that regulates the output voltage by applying a control signal to a gate terminal of the output transistor based on the reference voltage and the second current; and an adaptive bias generator that adjusts a ratio of the first and second currents based on a comparison of the second current to a reference current.

20. The device of claim 19 comprising an FDSOI semiconductor substrate including:

a first layer of semiconductor material;

a buried dielectric layer positioned on the first layer of semiconductor material; and a second layer of semiconductor material positioned on the buried dielectric layer.

21. The device of claim 20 wherein the feedback loop includes a loop transistor having:

a control gate coupled to a control gate of a pass transistor; and a back gate positioned in the second layer of semiconductor material, wherein the adaptive bias generator applies a back gate bias voltage to the back gate of the loop transistor and adjusts the ratio of the first and second currents by adjusting the back gate bias voltage.

* * * * *